US005209301A

United States Patent [19]

Ayres

[11] Patent Number: 5,209,301

[45] Date of Patent: May 11, 1993

[54] MULTIPLE PHASE CHEMICAL INJECTION SYSTEM

[76] Inventor: Robert N. Ayres, 142 S. Cockren's Green Cir., The Woodlands, Tex. 77381

[21] Appl. No.: 830,608

[22] Filed: Feb. 4, 1992

[51] Int. Cl.[5] ..... E21B 37/06

[52] U.S. Cl. ..... 166/305.1; 166/90; 166/902

[58] Field of Search ..... 166/305.1, 307, 75.1, 166/90, 902, 91, 53

[56] References Cited

U.S. PATENT DOCUMENTS

| | | | |
|---|---|---|---|
| 1,645,686 | 10/1927 | Brady . | |
| 2,752,067 | 6/1956 | Kohl et al. | 222/84.5 |
| 2,801,697 | 7/1957 | Rohrback | 166/1 |
| 2,884,067 | 4/1959 | Marken | 166/75 |
| 3,228,472 | 1/1966 | Rhoads, Jr. | 166/75.1 X |
| 3,700,031 | 10/1972 | Germer, Jr. et al. | 166/274 X |
| 4,390,061 | 6/1983 | Short | 166/68 X |
| 4,436,148 | 3/1984 | Maxwell | 166/53 |
| 4,582,131 | 4/1986 | Plummer et al. | 166/68 |
| 4,593,763 | 6/1986 | Burke | 166/302 |
| 4,796,697 | 1/1989 | Ayres | 166/310 |
| 4,830,112 | 5/1989 | Erickson | 166/53 X |
| 4,896,726 | 1/1990 | Ayres | 166/312 |

OTHER PUBLICATIONS

Containment Incorporated, "Spilguard System 55 & System 80".

*Primary Examiner*—William P. Neuder

[57] ABSTRACT

An apparatus and method for injecting chemicals into a hydrocarbon producing well is disclosed. The invention includes a first vessel for containing the chemical, a second vessel for containing a pressurized gas, a conduit for permitting the pressurized ga to pressurize the chemical, and a valve for selectively permitting the chemical to exit the first vessel The pressurized gas drives the chemical through the valve and into the well without releasing the chemical into the ambient environment.

18 Claims, 1 Drawing Sheet

MULTIPLE PHASE CHEMICAL INJECTION SYSTEM

FIELD OF THE INVENTION

The present invention relates to an improved apparatus and method for injecting chemicals into a hydrocarbon producing well. More particularly, the present invention relates to a pressure vessel which contains the chemical and a pressurized gas which urges the chemical from the vessel and into the hydrocarbon producing well.

BACKGROUND OF THE INVENTION

In the production of oil, gas and other hydrocarbons, a tubing string is often positioned within the well casing. The hydrocarbons enter the tubing through perforations located at the lower end of a tubing string. In some wells, the hydrocarbons are pumped to the surface with a sucker rod pump located on the surface or with a downhole submersible pump. At the well surface, production equipment directs the hydrocarbon fluids to holding tanks or to a pipeline. The well production equipment typically comprises tubing, valves, piping, and other components.

The hydrocarbon fluids contain numerous compounds which adversely affect the well production equipment. For example, paraffins and water/oil emulsions can coat the well production equipment and eventually plug perforations in the tubing. In addition, chemical reactions between the hydrocarbon fluids and metallic equipment can cause scale to be formed on the well production equipment, and corrosive compounds in the hydrocarbon fluids can physically corrode the well production equipment.

Various techniques can treat these well conditions to extend the useful life of the well production equipment. In wells susceptible to paraffin build-up, "treater trucks" are regularly dispatched to pump hot oil into the well. The hot oil enters the casing, melts the paraffin deposits in the well production equipment, and returns to the surface through the tubing. For wells susceptible to corrosion and scale problems, high pressure injection trucks pump batches of chemicals into the well to chemically remove the scale, and to inhibit the cause of corrosion. All of these practices require regular maintenance services which are costly and which do not continuously treat the well. Batch treatments of wells is less efficient than continuous treatment because more chemicals are typically injected in batch treatment operations.

To avoid inefficiences associated with treater truck maintenance of hydrocarbon producing wells, well operators use mechanical pumps to inject chemicals into a well. Typically, mechanical pumps are supplied from a storage tank which holds the chemicals. The mechanical pumps and storage tanks are located adjacent the well for several reasons, such as for reducing the length of the power cable connected to the pump. The tanks are located above the pump and the chemical is gravity fed to the intake port of the pump. These tanks include a vent at the upper end of the tank to prevent a vacuum from developing in the tank as the pump draws chemical from the tank. In addition, the vent releases excess pressure within the tank caused by thermal expansion of the chemical. Such thermal expansion can cause the chemical vapors to be released into the environment through the vent. In addition, thermal expansion can cause the chemical to be ejected through the vent or through the sight glass used to indicate the chemical level in the tank. In either event, chemical vapors of the chemical fluids are released in an uncontrolled manner and can pose a hazard to personnel and to the environment.

The mechanical pumps used in chemical injection systems are powered by electricity or gas and include numerous moving components. It is customary to inspect these pumps on a regular basis, sometimes daily, to verify the operability of the pumps. Because the chemical is gravity fed to the intake of the chemical pump, sediment in the tank or the chemical settles toward the pump intake and can interfere with the operation of the pump. In addition, the presence of an air bubble in the intake line can impede the operation of the pump because of a vapor lock. In such event, maintenance personnel routinely open a bleeder valve on the pump and release chemical from the pump until the air bubble has been cleared. This practice is undesirable because it releases chemical into the environment.

Presently available systems contain moving components which are subject to failure and require regular maintenance. Such systems are also undesirable because they vent chemicals into the environment. Accordingly, a need exists for a system which injects chemicals into a hydrocarbon producing well without moving components and without releasing the chemicals into the environment.

SUMMARY OF THE INVENTION

The present invention overcomes the limitations of the prior art by disclosing a closed system which can inject chemicals into a hydrocarbon producing well without using moving equipment. A first vessel for containing the chemical and a second vessel are connected by a fluid communication means. A pressurized gas is located in the second vessel and communicates pressure to the chemical through the flow communication means. A valve is located between the first vessel and the well for selectively permitting the chemical to exit the first vessel and to enter the well. In an alternative embodiment of the invention, a pressure regulator can be connected to the flow communication means to control the flow of pressurized gas a it pressurizes the chemical. The method of the invention comprises the steps of installing the chemical into the first vessel, of injecting the pressurized gas into the second vessel so that the pressurized gas pressurizes the chemical, and of operating the valve to selectively permit the chemical to exit the first vessel and to enter the well.

DESCRIPTION OF THE PREFERRED EMBODIMENTS

Figure 1:
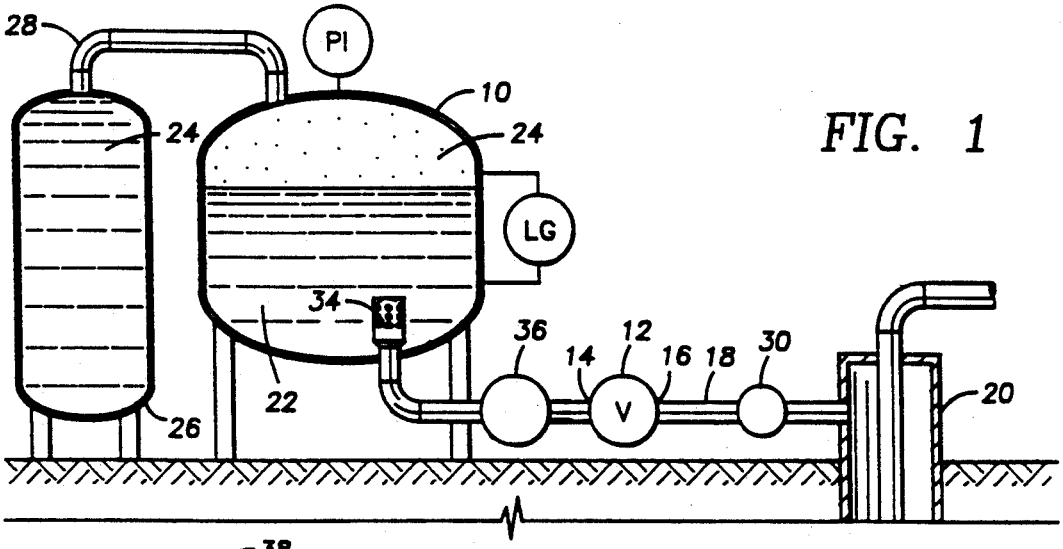
FIG. 1 illustrates a schematic view of a first vessel for containing the chemical, a second vessel for containing the pressurized gas, flow communication means between the first and second vessels, and a valve for selectively controlling the flow of chemical into the well.

The present invention overcomes the limitations of the prior art by providing a unique apparatus and method for injecting a chemical into a hydrocarbon producing well. Referring to FIG. 1, first vessel 10 comprises a container which is capable of holding an internal pressure without failure. Vessel 10 is distinguishable from containers such as tanks which are only designed to withstand the hydrostatic pressure exerted by the fluid in the tank Preferably, vessel 10 is constructed from a fiberglass, stainless steel, epoxy resin, or other material which is resistant to degradation induced by chemicals and corrosive gases. Alternatively, vessel 10 can be constructed from a material which is coated with an inner lining (not shown) resistant to corrosion.

Valve 12 is attached to the lower end of vessel 10 and has an inlet end 14 in fluid communication with vessel 10. Valve 12 can comprise a micrometering valve which is adjustable to increase or decrease the flow rate. Outlet end 16 of valve 12 is connected to one end of fluid line 18, and the other end of fluid line 18 is attached to well 20. In another embodiment, fluid line 18 is connected between vessel 10 and well 20, and valve 12 is in fluid communication with fluid line 18. A filter (not shown) can be installed in line 18 to prevent solid particles in chemical 22 from contaminating valve 12. In another embodiment, line 18 can be connected to the lower end of vessel 10 and can rise upwards so that gravity acts against solid particles in chemical 22 to prevent the solid particles from entering valve 12.

Although well 20 can comprise a hydrocarbon producing well, the present invention is useful in other wells relating to the production of hydrocarbon wells such a injection wells used in enhanced recovery operations. As used throughout this disclosure, the terms "well" and "hydrocarbon producing well" will include all wells directly of incidentally associated with the production or injection of fluids containing hydrocarbons.

Chemical 22 is contained in vessel 10 in liquid form. As contemplated by the present invention, chemical 22 can comprise any liquid compound or material to be injected into a hydrocarbon producing well. As representative examples, without limiting the scope of the invention, chemical 22 can comprise chemicals generally identified as scale inhibitors, water clarifiers, demulsifiers, and other chemicals which inhibit the formation of chemical or metallic compounds in hydrocarbon producing wells.

Pressurized gas 24 is also located in vessel 10. Pressurized gas 24 preferably comprises a gas which does not chemically react with chemical 22, and may comprise readily available gases such as nitrogen, helium, argon, or carbon dioxide. The density of pressurized gas 24 is preferably less than the density of chemical 22 so that chemical 22 is concentrated toward the lower end of vessel 10, and pressurized gas 24 is concentrated toward the upper end of vessel 10. As shown in FIG. 1, pressurized gas 24 is in contact with chemical 22 and pressurizes chemical 22 to the same pressure as that of pressurized gas 24. Pressurized gas 24 is also contained in second vessel 26 and in flow communication means or conduit 28. Second vessel 26 can be similar to first vessel 10 in configuration and composition, or can be different. Pressurized gas 24 in vessel 26 can be contained in a gaseous state, or in a combination of gaseous and liquid states.

In operation, valve 12 is initially closed to prevent the release of chemical 22 from vessel 10 Valve 12 is then selectively opened and pressurized gas 24 urges chemical 22 through valve 12, through line 18, and into well 20. Preferably, valve 12 is adjustable to selectively control the flow of chemical into well 20. Valve 12 can be set to selectively adjust the flow rate into well 20, and to increase or decrease the flow rate of such chemical. This feature is an important feature of the present invention, since the precise injection rate of chemical 22 accomplishes several objectives. Certain wells require large volumes of chemicals to accomplish the desired function. Other wells require only relatively small quantities of chemicals to accomplish the desired results. For example, certain wells may require only a fraction of a gallon per day to accomplish the desired result, and the injection of additional chemicals is unnecessary to the operation of the well. If more chemical than required is injected into the well, then the excess chemical is superfluous to the operation of the well and results in additional cost to the operator. The present invention accomplishes this desired result by selectively controlling the flow rate of the chemical and by preventing higher than required flow of chemical.

The present invention can be adjusted to control the flow of chemical in several different ways. In one embodiment of the invention, valve 12 continuously permits chemical 22 to exit vessel 10 and to enter well 20. In another embodiment, valve 12 can be configured to selectively permit a selected quantity, or batch, of chemical 22 into well 20. This batch feature can be accomplished by a timer mechanism (not shown) or mechanical device incorporated into valve 12 through techniques well-known in the art. The continuous feed embodiment is preferable to batch treatments because it permits the continuous treatment of the well on a full-time basis. In certain applications, continuous treatment will prevent corrosion or paraffin buildup from adversely affecting the performance of the downhole well equipment. This advantage is not presently realized by batch treatments because the chemicals are only injected during a small period relative to the total operation of the well.

Referring to FIG. 1, check valve 30 is installed in line 18 to prevent the backflow of fluids in well 20 from back flowing into vessel 10. This feature is desirable because a well operator could accidentally pressurize well 20 to a pressure higher than that of chemical 22. Alternatively, this function could be incorporated into the design of valve 12. In addition, chemical inlet 32 is located in vessel 10 to permit the injection of chemical 22 into vessel 10. During such refilling, chemical 22 should be injected under pressure into vessel 10. This injection under pressure is necessary to overcome the pressure exerted by pressurized gas 24. Preferably, chemical 22 should be injected into vessel 10 under a pressure which is greater that the pressure of pressurized gas 24, but is less than the liquification pressure of pressurized gas 24. If the liquification pressure is exceeded, the the injection of chemical 22 into vessel 10 would cause pressurized gas 24 in vessel 10 to liquify with the undesirable consequences set forth above.

Float or similar means 34 is located in vessel 10 to prevent pressurized gas 24 from exiting vessel 10. In one embodiment of the invention, float 34 has a density less than that of chemical 22 and is buoyant therein. As the level of chemical 22 is lowered in vessel 10 by releasing chemical 22 through valve 12, float 34 will be lowered in vessel 10. When float 34 reaches a selected position within vessel 10, at a point when the level of chemical 22 is low within vessel 10, float 34 seals inlet 16 of valve 12 to prevent the release of pressurized gas into valve 12. This function can be accomplished in other ways other than by using float 34. For example, a sight glass (not shown) could be used to visually indicate the level of chemical 22 within vessel 10 so that valve 12 can be closed before pressurized gas 24 exits vessel 10. In other embodiments, mechanical, electrical, or electronic guages could be utilized to indicate the level of chemical 22 within vessel 10 or, alternatively, to otherwise prevent the discharge of pressurized gas from vessel 10 when chemical 22 reaches a certain level.

As shown in FIG. 1, pressure regulator 16 is located between first vessel 10 and valve 12. In this embodiment, regulator 36 controls the pressure of chemical 22 which is in contact with valve 12. For example, if the pressure of pressurized gas 24 and chemical 22 in vessel 10 is 500 psi, regulator 36 can reduce the pressure of chemical in contact with valve 12 to a desired pressure greater than the well pressure. As a representative example, if the pressure of well 20 was 90 psi, and the desired pressure differential across valve 12 was 10 psi, regulator 36 could reduce the pressure of chemical 22 from 500 psi to 100 psi. Regulator 36 should not reduce the pressure of chemical 22 below the pressure in well 20 because this would cause fluids in well 20 to enter valve 12. To prevent this accidental occurence, check valve 30 can prevent the accidental reversal of pressure gradient. In other embodiments of the invention, regulator 36 can be located between valve 12 and well 20 to control the pressure differential between valve 12 and well 20. In another embodiment, pressure regulators similar to regulator 36 can be located on both sides of valve 12. In this embodiment, the differential pressure across valve 12 can be precisely controlled by selectively controlling the pressure differential between first vessel 10 and valve 12, and between valve 12 and well 20.

The control of the pressure differential across valve 12 is important because the flow rate through certain types of valves is dependent on the size of the valve orifice and the pressure differential across the valve inlet and outlet ports. As the pressure differential across a valve increases, the flow rate through the valve will typically increase accordingly unless the valve is designed to maintain a steady flow rate in response to varying flow pressures. As steady rate valves are more expensive that other valves which do not have a pressure compensation capability, pressure regulator 36 assists in controlling the flow rate of chemical through valve 12. Regulator 36 is also useful because the use of regulator 36 in conjunction with valve 12 permits the precise control of small quantities of chemical 22. Since the flow rate through a valve is usually an inverse function of the pressure differential acting across the valve and the size of the valve aperture, high differential such as 500 psi would force a large quantity of chemical through the valve unless the valve aperture was extremely small. Limiting the flow rate of chemical through a valve to quantities less than one gallon would be difficult without the use of a valve specifically designed for such purpose. The present invention overcome this problem by using regulator 36 to control the differential pressure acting across valve 12. This feature permits the control of relatively small chemical flow rates across valve 12.

Figure 2:
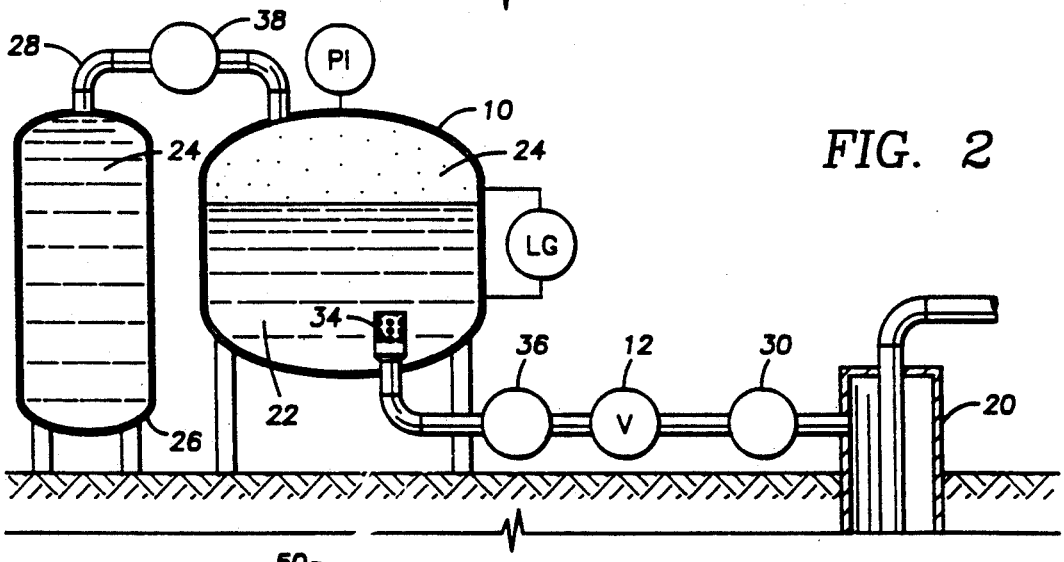
FIG. 2 illustrates a schematic view of the invention and shows a pressure regulator connected to the flow communication means.

FIG. 2 illustrates an alternative embodiment of the invention wherein pressure regulator 38 is connected to conduit 28. In this embodiment, regulator 38 selectively controls the pressure acting on chemical 22 by controlling the pressure of pressurized gas 24 in first vessel 10. In this embodiment of the invention, pressurized gas 24 in second vessel 26 can be principally in a liquid state, as regulator 38 reduces the pressure of pressurized gas 24 in vessel 10 to a pressure less than the liquification pressure of such gas at the operating temperature. Since the volume of a gas in the liquid state is substantially less than the volume of of the gas in the gaseous state, more pressurizing energy per volumemetric unit can be stored in second vessel 26 if the pressurized gas is in a liquid state instead of a gaseuos state. This stored energy can be increased by increasing the pressure of pressurized gas 24 in vessel 26. This increased pressure will not affect the operation of valve 12 because of regulator 38. In this embodiment of the invention, regulator 38 maintains chemical 22 at a constant pressure, and the pressure differential across valve 12 can be controlled by connecting pressure regulator 40 between valve 12 and well 20. This embodiment furnishes the advantages described above for controlling the pressure differential acting across valve 12.

Figure 3:
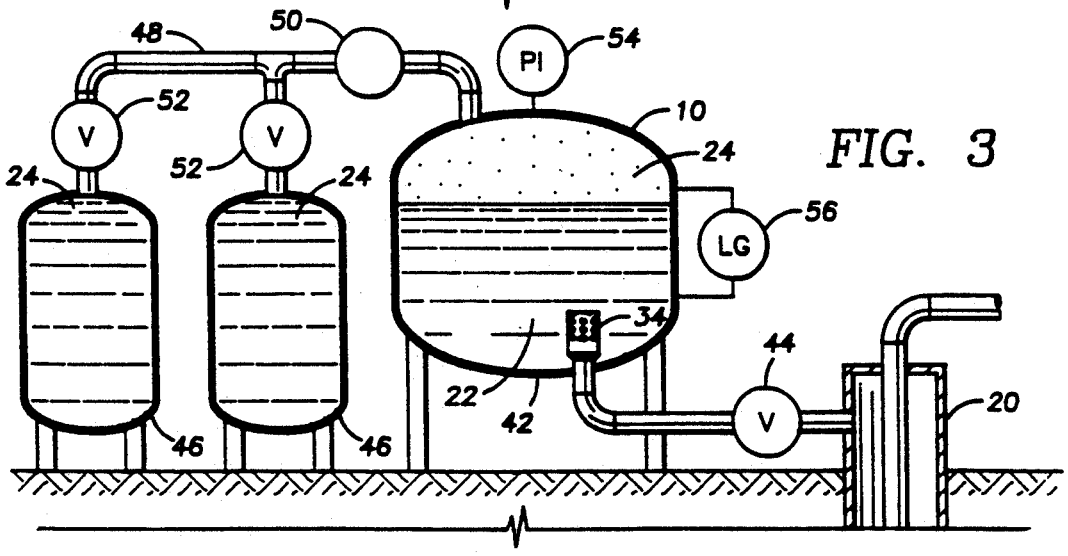
FIG. 3 illustrates a schematic view of the invention and shows more than one vessel for containing the pressurized gas.

FIG. 3 illustrates an alternative embodiment of the invention wherein more than one vessel contains pressurized gas 24. Vessel 42 contains chemical 22 and is connected to valve 44. Valve 44 is also connected to well 20 as described in other embodiments of the invention. Vessels 46 are connected by conduit 48 to pressure regulator 50, which is in fluid communication with vessel 42. Vessels 46 contain pressurized gas 24 in a liquid state, gaseous state, or mixed state. Pressurized gas 24 is communicated to regulator 50 through conduit 48, and is then injected into vessel 42 to pressurize chemical 22. Multiple vessels for storing pressurized gas 24 is useful where high injection pressures are necessary to overcome high pressure in well 20, and where the injection equipment will be left unattended for long periods of time. In addition, this embodiment permits the advance installation of pressurized gas 24 in environments where access to well 20 is severely limited, such as in remote geographic areas. Multiple vessels 46 for containing pressurized gas 24 has several advantages over a single vessel in certain applications. For example, valves 52 can be connected in conduit 48 to selectively isolate a vessel 46 from regulator 50. Consequently, one of vessels 46 can be removed or replaced, by closing the corresponding valve 52, without encumbering the operation of the apparatus. In addition, the manufacture of smaller pressure vessels may be less expensive than for a single large pressure vessel having the same cumulative capacity, which results in lower cost.

Pressurized guage 54 is attached to vessel 42 to measure the pressure of pressurized gas 24. Guage 56 is attached to vessel 42 for measuring the quantity of chemical 22 in vessel 42. Guage 56 can comprise many different embodiments such as sight glasses, electromagnetic switches, and other devices well-known in the art. In addition, guage 56 can comprise a flow meter which measures the quantity of fluid flowing from vessel 42. When the fluid quantity flowing from vessel 42 is compared to the quantity of chemical 22 installed in vessel 42, the quantity of chemical 22 in vessel 42 at any point in time can be determined.

The present invention provides a novel method of injecting chemical into a hydrocarbon producing well. The invention controls the rate of chemical injection and can be adjusted to inject chemicals at large or small flowrates. The chemical is injected without the need for pumps or other mechanical devices which require maintenance and are subject to operational failure. The invention uniquely prevents the discharge of the chemical or pressurized gas into the environment by disclosing a closed injection system which does contain vents and does not permit chemical releases into the environment. Because the vessel is closed, aromatic compounds in the chemical are not vented to the environment. The absence of a vent further reduces the risk of fire due to flammable chemicals and reduces the contact between chemical vapors and well personnel. Moreover, the invention permits the continuous injection of chemicals into the well, and prevents corrosion or undersirable deposits from accumulating in the well.

The present invention is particularly useful in remote or environmentally hostile regions. The absence of moving components reduces the maintenance required for the chemical injection system, in contrast to the regular care necessary for chemical pumps. Because the chemical is pressurized within the vessel, pressure changes in the chemical due to variations in the ambient temperature will be less significant than if the chemical was contained by an unpressurized storage tank. Consequently, the present invention is readily adaptable to offshore, arctic and tropical environments. In offshore platforms, the invention furnishes significant flexibility in the deck location of the vessel. In arctic environments subject to intense cold, antifreeze can be blended with the chemical to prevent icing in the valve, pressure regulator, and flow lines. In arctic or tropical environments, it may be desirable to insulate certain components of the invention to minimize the effects of temperature extremes. The pressurized gas can further be used to automatically inflate balloons or markers connected to a vessel for supporting a vessel displaced into the water from an offshore platform, or for identifying the location of the vessel after it has been otherwise displaced from a well site.

The embodiments of the invention shown herein are illustrative only and do not limit the scope of the invention. It will be appreciated that numerous modifications and improvements may be made to the inventive concepts herein without departing from the scope of the invention.

What is claimed is:

1. An apparatus for selectively injecting a chemical into a well, comprising:

a first pressure vessel for containing a quantity of the chemical, wherein said first pressure vessel is closed to atmospheric pressure;

a second pressure vessel closed to atmospheric pressure;

flow communication means connected between said first pressure vessel and said second pressure vessel;

a pressurized gas located in said second pressure vessel, wherein said pressurized gas is in liquid and gaseous states, and wherein said pressurized gas communicates pressure to the chemical through said flow communication means; and a valve in fluid communication with said first pressure vessel and the well for selectively permitting the chemical to exit said first pressure vessel, due to pressure induced by said pressurized gas, and to enter the well.

2. An apparatus as recited in claim 1, further comprising a pressure regulator in fluid communication with said valve for controlling the pressure of the chemical.

3. An apparatus as recited in claim 1, further comprising a first pressure regulator located in fluid communication between said first pressure vessel and said valve for controlling the pressure of the chemical.

4. An apparatus as recited in claim 1, further comprising a gas pressure regulator connected to said flow communication means for controlling the pressure of said pressurized gas in contact with the chemical in said first pressure vessel.

5. An apparatus as recited in claim 3, further comprising a second pressure regulator connected between said valve and the well for controlling the pressure of the chemical in contact with said valve.

6. An apparatus as recited in claim 5, wherein said first and second pressure regulators control the pressure differential acting across said valve.

7. An apparatus as recited in claim 4, wherein said pressurized gas is substantially in a liquid state.

8. An apparatus as recited in claim 1, further comprising means for preventing said pressurized gas from exiting said first pressure vessel.

9. An apparatus as recited in claim 1, further comprising a gas pressure regulator connected to said flow communication means for controlling the flow of pressurized gas through said flow communication means and into contact with the chemical.

10. An apparatus as recited in claim 9, further comprising an outlet connected to said first pressure vessel for selectively releasing pressurized gas from said first pressure vessel.

11. An apparatus as recited in claim 1, further comprising means for installing chemical into said first pressure vessel.

12. An apparatus as recited in claim 1, further comprising means for indicating the quantity of chemical within said first pressure vessel.

13. An apparatus as recited in claim 1, further comprising means for preventing said pressurized gas from exiting said first pressure vessel and contacting said valve.

14. An apparatus as recited in claim 1, further comprising a third pressure vessel in fluid communication with said flow communication means, wherein said third pressure vessel is closed to atmospheric pressure, and wherein said third pressure vessel contains a pressurized gas in liquid and gaseous states.

15. An apparatus as recited in claim 1, wherein said valve is in fluid communication with at least two wells, and wherein said valve controls the injection of chemical into said wells.

16. A method for continuously injecting a chemical into a well, comprising the steps of:

installing the chemical into a first pressure vessel which is in fluid communication with a valve, wherein said first pressure vessel is closed to atmospheric pressure;

injecting a pressurized gas into a second pressure vessel, which is closed to atmospheric pressure, so that said pressurized gas contacts the chemical through a flow communication means connected between said first pressure vessel and said second pressure vessel; and operating said valve to selectively permit the chemical to exit said first pressure vessel and to enter the well as said pressurized gas urges the chemical from said first pressure vessel.

17. A method as recited in claim 16, further comprising the step of preventing said pressurized gas from exiting said first pressure vessel.

18. A method as recited in claim 16, further comprising the step of regulating the pressure of the chemical with a pressure regulator connected in fluid communication with said valve.

* * * * *